US008827175B2

(12) United States Patent
Fritsch et al.

(10) Patent No.: US 8,827,175 B2
(45) Date of Patent: Sep. 9, 2014

(54) METHOD AND DEVICE FOR THE CALIBRATION OF FUEL INJECTORS

(75) Inventors: Jürgen Fritsch, Regensburg (DE); Johann Görzen, Aindling (DE)

(73) Assignee: Continental Automotive GmbH, Hannover (DE)

( * ) Notice: Subject to any disclaimer, the term of this patent is extended or adjusted under 35 U.S.C. 154(b) by 1083 days.

(21) Appl. No.: 12/597,001

(22) PCT Filed: Apr. 18, 2008

(86) PCT No.: PCT/EP2008/054758

§ 371 (c)(1), (2), (4) Date: Oct. 22, 2009

(87) PCT Pub. No.: WO2008/129008

PCT Pub. Date: Oct. 30, 2008

(65) Prior Publication Data

US 2010/0116911 A1 May 13, 2010

(30) Foreign Application Priority Data

Apr. 23, 2007 (DE) ..... 10 2007 019 099

(51) Int. Cl.

| | |
|---|---|
| ***F02D 1/06*** | (2006.01) |
| ***F02D 7/00*** | (2006.01) |
| ***B05B 1/30*** | (2006.01) |
| ***F02M 51/00*** | (2006.01) |

(52) U.S. Cl.
USPC ..... 239/5; 239/585.1; 123/478; 123/480

(58) Field of Classification Search
USPC ..... 239/5, 533.1, 533.2, 533.6, 75, 76, 239/585.1; 123/357, 478, 480
See application file for complete search history.

(56) References Cited

U.S. PATENT DOCUMENTS 4,402,294 A 9/1983 McHugh et al.
4,423,485 A * 12/1983 Sami et al. ..... 701/104

(Continued)

FOREIGN PATENT DOCUMENTS

DE 4134304 A1 4/1993
DE 10041076 A1 3/2002

(Continued)

OTHER PUBLICATIONS

Chinese Office Action, Application No. 200880012999.4, 26 pages, Feb. 6, 2013.

(Continued)

*Primary Examiner* — Len Tran
*Assistant Examiner* — Alexander M Valvis
(74) *Attorney, Agent, or Firm* — King & Spalding L.L.P.

(57) ABSTRACT

In a method and a device for the calibration of internal combustion engines, in each fuel injector, at least one actuator element (1) may be activated by an electric signal interacts with at least one injection valve (3) having an injection rate for the supply of fuel to a combustion chamber (5) via injection holes, and in the case of a flow characteristic curve (12, 23, 35) of the fuel flowing through the injection holes deviating from a target characteristic curve (11, 22, 34) in a flow-time diagram, a signal characteristic curve (14*a*, 27, 42) of the electric signal applied to the actuator element (1) is altered in a voltage-time diagram relative to a target characteristic curve (13, 26, 41) by a controller.

21 Claims, 8 Drawing Sheets

(56) References Cited

U.S. PATENT DOCUMENTS

| | | | | | |
|---|---|---|---|---|---|
| 5,000,042 | A * | 3/1991 | Luebbering | 73/114.49 | |
| 5,289,627 | A * | 3/1994 | Cerny et al. | 29/602.1 | |
| 5,634,448 | A * | 6/1997 | Shinogle et al. | 123/480 | |
| 5,738,071 | A * | 4/1998 | Smith et al. | 123/357 | |
| 5,767,396 | A * | 6/1998 | Okamoto et al. | 73/114.49 | |
| 6,648,247 | B2 * | 11/2003 | McFarland | 239/585.1 | |
| 6,659,091 | B2 | 12/2003 | Wild et al. | | |
| 7,089,789 | B2 * | 8/2006 | Klopfer et al. | 73/114.45 | |
| 7,240,859 | B2 * | 7/2007 | Ricco et al. | 239/585.1 | |
| 7,310,994 | B2 * | 12/2007 | Gosger et al. | 73/37 | |
| 7,319,930 | B2 | 1/2008 | Dietl et al. | | |
| 8,020,834 | B2 * | 9/2011 | Ricco et al. | 251/129.16 | |
| 2002/0124838 | A1 | 9/2002 | Wild et al. | | |
| 2007/0162215 | A1 | 7/2007 | Dietl et al. | | |
| 2007/0200006 | A1 * | 8/2007 | Czimmek | 239/5 | |

FOREIGN PATENT DOCUMENTS

| | | | | | |
|---|---|---|---|---|---|
| DE | 102004006294 | B3 | | 10/2005 | |
| DE | 102005032087 | A1 | | 1/2007 | |
| DE | 102005032636 | A1 | | 1/2007 | |
| DE | 102005043087 | | * | 1/2007 | |
| EP | 0536676 | A2 | | 4/1993 | |
| EP | 0971115 | A2 | | 1/2000 | |
| EP | 1400674 | B1 | | 11/2005 | |
| FR | 2861427 | | * | 10/2003 | F02D 41/30 |
| FR | 2881427 | A1 | | 4/2005 | |
| JP | 2000130230 | A | | 5/2000 | F02D 41/20 |
| JP | 2002/201992 | A | | 7/2002 | F02D 41/40 |

OTHER PUBLICATIONS

Chinese First Office Action, Chinese Patent Application No. 200880012999.4 with English translation, 19 pages, Mar. 23, 2012.

International PCT Search Report, PCT/EP2008/054758, 11 pages, mailed Oct. 9, 2008.

German Office Action, German Application No. 10 2007 019 0990-26.

* cited by examiner

METHOD AND DEVICE FOR THE CALIBRATION OF FUEL INJECTORS

CROSS-REFERENCE TO RELATED APPLICATIONS

This application is a U.S. National Stage Application of International Application No. PCT/EP2008/054758 filed Apr. 18, 2008, which designates the United States of America, and claims priority to German Application No. 10 2007 019 099.0 filed Apr. 23, 2007, the contents of which are hereby incorporated by reference in their entirety.

TECHNICAL FIELD

The invention relates to a method and a device for the calibration of fuel injectors for internal combustion engines, with, in each injector, at least one actuator element that may be activated by an electric signal interacting with at least one injection valve having an injection rate for the supply of fuel to a combustion chamber via injection holes.

BACKGROUND

It is known from EP 0 536 676 A2 for instance that fuel injectors, which dose fuel into the internal combustion engine as a function of a control signal, are provided with a data carrier containing correction values, with which errors in the individual injectors can be equalized.

Provision is made here for the correction data at the end of the manufacture of each fuel injector, which varies from injector to injector as a result of certain manufacturing tolerances and implements the fuel delivery, to be determined and read into the data carrier. Here the data carrier can be embodied as a barcode or as a merely readable storage element. With the first initialization of the control device, this data is then read into a writeable memory of the control device and is used during subsequent operation to control the internal combustion engine.

Modern control devices have different functions, which likewise determine correction values which are to be assigned to an injector. Such a function is referred to as zero quantity calibration for instance. This data is stored in a control device and used to control the internal combustion engine.

The individual injection quantity of a fuel injector is usually detected at several check points within a test bench. The deviation of the respective injection quantity from the target value is determined here. This data is applied in a suitable form to the injector during manufacture of the injector. During engine assembly and/or motor vehicle assembly, the data is transmitted to the control device by way of suitable systems, for instance a diagnostic interface. In this context, methods exist for storing this data, which enable this control device to be replaced if an error occurs. These are known from EP 1 400 674 B1, according to which the classification of data on a storage apparatus, which is arranged directly on the fuel injector, is stored. The available data is used for the zero quantity calibration and/or quantity correction.

The problem frequently occurs here of an individual dosing of the fuel injectors in their overall operating range being needed in order to calculate correction data correspondingly and to indicate this on the fuel injectors. Dosing methods of this type which have been implemented on test benches are very time-consuming and expensive and are thus unsuited to the large-scale production of a large number of fuel injectors.

It should also be noted that fuel injectors are subject to ageing processes, which require the fuel injectors to be adapted to their respective functional states.

In DE 41 34 304 A1, several variables of a solenoid valve of a fuel injection device for an internal combustion engine are also detected in order to easily and rapidly compensate for irregularities during the injection process. Factors are determined on a test bench, which, as stored actuating variable factors, modify a previously calculated actuating variable for controlling the solenoid valve. This modified actuating variable then controls the solenoid valve. The determined factors are selected as a function of previously detected variables such that a selectable operating variable of the internal combustion engine is firstly adjusted, then a determination of an actuating variable, based on the marking arranged on a shaft of the internal combustion engine is calculated, an actual actuating variable is determined separately for this solenoid valve, giving the factor from the calculated actuating variable and the determined actuating variable. Storage of the determined factor and modification of the selectable operating variables are also implemented before these cited steps are repeated correspondingly often until an optimized functional state is established.

An injection system is known from U.S. Pat. No. 4,402,294 A, which implements a fuel injector calibration. A calibration resistor is used for the calibration, said resistor having a resistance which correlates with the fuel flow rate of the injector. The values thus determined are related to a number from a table. This number is then used to determine the time needed to operate the injector such that the desired fuel output is maintained.

It is also known to classify injectors with measurement data determined on a test bench into different groups, in order as a result for instance to obtain a group of injectors with low fuel delivery, a group of injectors with high fuel delivery and a group of injectors without significant deviations from the target values for the fuel delivery. Fuel injectors from just one group are then built into a motor vehicle and the control device is programmed accordingly. A classification of this type has the disadvantage that it combines a large number of injectors within a group still with—even if more minimally—different fuel delivery characteristics, so that even when fuel injectors from a common group are used, there is no optimal coordination of the fuel injectors used in a common motor.

SUMMARY

According to various embodiments, a method and a device for the calibration of fuel injectors for internal combustion engines can be provided, which enable the calibration of a large number of fuel injectors in a fast and cost-effective fashion if different fuel delivery characteristics of the individual fuel injectors are present.

According to an embodiment, in a method for the calibration of fuel injectors for internal combustion engines, with, in each fuel injector, at least one actuator element that may be activated by an electric signal interacting with at least one injection valve having an injection rate for the supply of fuel to a combustion chamber via injection holes, in the case of a flow characteristic curve of the fuel flowing through the injection holes deviating from a target characteristic curve in a flow-time diagram, a signal characteristic curve of the electric signal applied to the actuator element is modified in a signal-time diagram relative to a target characteristic curve by means of a controller.

According to a further embodiment, if a flow value which is too high or too low occurs, the at least partially simultaneously applied signal can be reduced early or with a delay. According to a further embodiment, an early signal increase and an early signal drop can be implemented if a delayed flow start and a delayed flow end occur. According to a further embodiment, an early signal increase and an increase in the maximum signal value can be implemented if a delayed flow start and a reduced flow increase occur. According to a further embodiment, a delayed signal drop can be implemented.

According to a further embodiment, an opening signal value provided for the opening of the injection valve can be increased. According to a further embodiment, the actuator element can be embodied as a piezo element, which interacts with a control valve with a first stroke length, which controls the injection valve with a second stroke length, or directly interacts with the injection valve without the control valve. According to a further embodiment, the actuator element can be embodied as a magnet element, which optionally interacts with the injection valve by way of a control valve. According to a further embodiment, the electric signal may represent an applied electric voltage, the signal characteristic curve may represent a voltage characteristic curve, the signal-time diagram may represent a voltage-time diagram, the signal increase may represent a voltage increase, the signal drop may represent a voltage drop and the signal value may represent a voltage value. According to a further embodiment, in order to determine the flow characteristic curve deviating from the target characteristic curve, the fuel quantity flowing through the injection holes can be measured as a function of time in a test bench facility. According to a further embodiment, to determine the flow characteristic curve deviating from the target characteristic curve, measured time values in respect of the fuel quantity flowing through the injection holes may be transformed in the frequency range and further processed there. According to a further embodiment, the modification values of the signal characteristic curve values produced can be stored or printed as correction values in/on a data carrier connected to the injector or assigned to different resistance values.

According to another embodiment, an apparatus for the calibration of fuel injectors for internal combustion engines, with each fuel injector having at least one actuator element that may be activated by an electric signal, which interacts with at least one injection valve with an injection rate for the supply of fuel to a combustion chamber via injection holes, may further comprise a controller, which in the case of a flow characteristic curve of the fuel flowing through the injection holes deviating from a target characteristic curve in a flow-time diagram, controls a change in a signal characteristic curve of the electric signal applied to the actuator element in a signal-time diagram relative to a target characteristic curve.

BRIEF DESCRIPTION OF THE DRAWINGS

Advantages and expediencies can be inferred from the description below in conjunction with the drawing, in which.

DETAILED DESCRIPTION

Figure 1A:
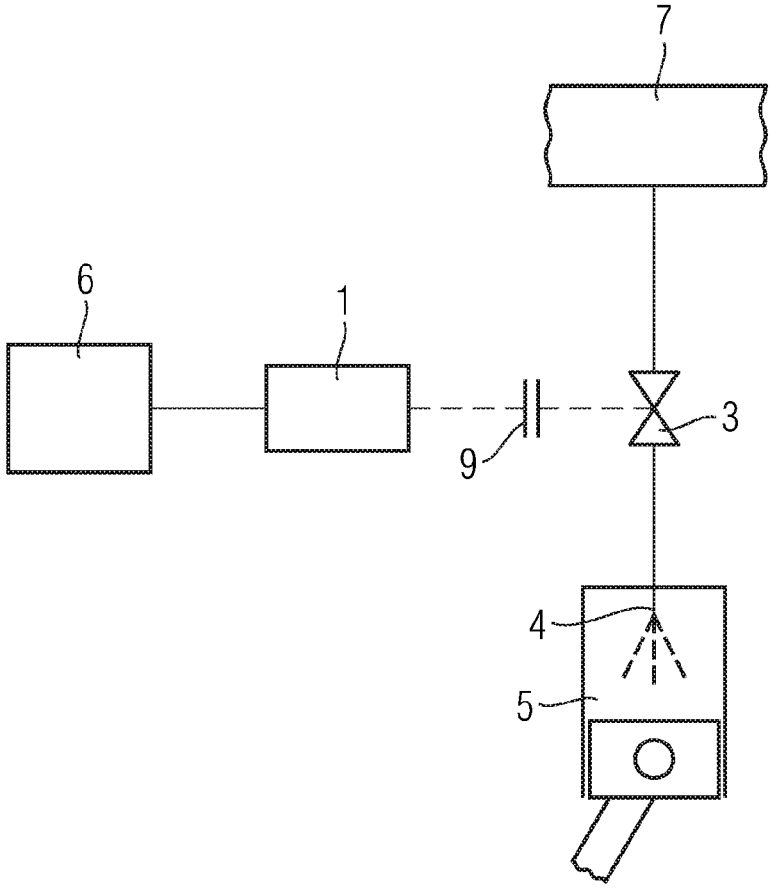
FIG. 1A shows a schematic view of individual elements of a structure for a direct activation of an injection valve in a fuel injector.

According to various embodiments, a signal characteristic curve of the electric signal applied to the actuator element is modified in a signal-time diagram by means of a controller relative to a target characteristic curve in the case of a method for the calibration of fuel injectors for internal combustion engines, which, in each injector, have at least one actuator element which may be activated by means of an electric signal, said actuator element interacting with at least one injection valve having an injection rate for the supply of fuel to a combustion chamber via injection holes, in the case of a flow characteristic curve of the fuel flowing through the injection holes deviating from a target characteristic curve in a flow-time diagram. Provided a piezo element is used as an actuator element, said piezo element interacting with a control valve with a first stroke length, which controls the injection valve with a second stroke length, the electric signal is preferably electrical voltage values. Alternatively, the injection valve can interact directly with the piezo element. Accordingly, the signal characteristic curve represents a voltage characteristic curve, the signal-time diagram a voltage-time diagram, the signal increase a voltage increase, the signal reduction a voltage reduction and the signal value a voltage value. The voltage is used here to move the piezo element accordingly. The determination of the flow characteristic and thus a deviation of the flow characteristic curve from its target characteristic curve enables a subsequent adjustment and/or correction of the ejected fuel content by means of the voltage characteristic curve in a simple and rapid fashion, irrespective of whether a correction control of this type is indicated in terms of its values on the exterior of the injector or is stored in a memory, which is either connected to the injector or to the controller. As the movement of the piezo element in the form of a piezo crystal is proportional to the voltage applied thereto and the first and second stroke lengths of the control valve and the injection valve are therefore very different, a variable flow can be implemented as a correction for the actual flow measured previously.

Very different types of fuel delivery deviations can be corrected in this way, for instance an error in the flow present within the injector, a dead time error within the injector existing as a result of the time delay between the actuation of the control valve and the injection valve or a correction of an idle stroke error, which can then occur for instance if the piezo crystal initially has to cover a certain idle stroke length before it makes contact with the control valve.

Such a correction of the voltage curve on the basis of the measurement of a flow characteristic curve which is not as desired, allows a large number of fuel injectors to be obtained with the most minimal or even no deviations in terms of their flow characteristic over the whole operating range of the fuel injectors, with the fuel injectors only having to be dosed at individual working points within the operating range within the scope of large scale production.

As an alternative to direct piezo control, in other words control of the fuel injector by means of a piezo element acting directly on the injection valve, or indirect piezo control, in other words control of the fuel injector by means of a piezo element acting on a control valve, which controls the injection valve, direct or indirect magnetic control can likewise be used, with a magnetically active element being used to move the injection valve and/or the control valve instead of the piezo element.

Voltage values or current values and/or capacitive or inductive values can be used accordingly as electric signals. In respect of the capacitive values, $Q=C\cdot U$ applies here for the electrical charge used and $E=\frac{1}{2}\,C\cdot U$ for the energy and in respect of the inductive values $\Phi=L\cdot I$ for the flow and $E=\frac{1}{2}L\cdot I$ in respect of the energy used.

For a possible analysis to determine the flow characteristic of individual fuel injectors, it is possible to use the injection profile of the fuel leaving the injection nozzles itself, discrete characteristic values from the time range of the injection characteristic or discrete characteristic values from the frequency range of the injection characteristic.

These values generally permit the determination of individual errors in terms of functionality and the flow characteristic of the fuel injectors, namely for instance the determination of an idle stroke or a dead time.

As a function of these determined errors, in the case of the voltage applied to the piezo element, it is possible to carry out corresponding corrections, such as for instance at the start of activation (TB), of the charging energy (E) and the activation duration (TA) and/or injection duration (TE), thereby correcting the errors at least in a variation range, which allows the fuel injectors to be tailored to one another.

In general terms, idle stroke deviations and deviations in the flow characteristic are compensated for here by way of the activation duration and/or injection duration, while dynamic deviations are compensated for during operation of the fuel injector by way of energy regulation.

The correction data obtained therefrom can advantageously be fed directly back into the manufacturing process of the subsequent fuel injectors for quality assurance purposes.

To correct a flow error in the fuel leaving through the injection holes and/or nozzles, if a flow value which is too high or too low occurs, the at least partially simultaneously applied voltage can be varied, for instance reduced, early or with a delay. This allows a shorter and/or longer activation duration as a result of a shorter or longer displacement and/or movement of the piezo crystal.

If a delayed flow start and a delayed flow end occur, an early voltage increase and an early voltage drop can be implemented. This results in correction of the dead time error, which can be corrected by a correspondingly earlier or later voltage application.

To correct an idle stroke error, if a delayed flow start and a reduced flow increase occur, an early voltage increase and an increase in the maximum voltage value are implemented and if necessary a delayed voltage drop is practiced. This produces a voltage pattern in a voltage-time characteristic curve which results in a flow pattern of the flow characteristic curve, which has the same integral value below the characteristic curve as that of the desired target characteristic curve. This applies likewise to the intended corrected flow characteristic curves for correcting the dead time and the flow error.

If an idle stroke error occurs, the opening voltage value needed to open the injection valve is increased in order thereby to achieve opening of the injection valve with a higher voltage than the voltage increasing in this case more rapidly as a correction. This results in an opening of the injection valve from a voltage value which matches the opening time of a nominal injector and is so high that the subsequent increased maximum voltage would not result in an excessively long injection of fuel.

To determine the flow characteristic curve deviating from the target characteristic curve, the actual fuel quantity flowing through the injection holes is measured as a function of time in a test bench facility. Alternatively, the values transformed in the frequency range can be used.

The modification values produced for the voltage characteristic curve are preferably stored as correction values in a data carrier connected to the injector.

A device for the calibration of fuel injectors for internal combustion engines, in which each fuel injector has the piezo element, the control valve and the injection valve, also advantageously has a controller, which in the case of the flow characteristic curve of the fuel flowing through the injection holes deviating from the target characteristic curve in the flow-time diagram, controls the change in the voltage characteristic curve of the voltage applied to the piezo element in a voltage time diagram relative to the target characteristic curve.

FIG. 1A shows a schematic representation of individual elements of a structure for a direct activation in a fuel injector.

An injector, consisting of an actuator 1 (here a piezo element) and a needle functioning as a valve 3, is connected to a rail 7. The piezo actuator 1, which in electrical terms functions as a capacitor 9, is operated by a control device 6 (ECU).

The injection valve 3 implements upward and downward movements, which act on an injection nozzle 4. By way of example, the injection nozzle includes a stylus-shaped element in the form of an injection needle, which can open or close an opening by means of the upward and downward movements. Provided a revealed opening is present, fuel surrounding the needle flows into the opening and is injected into a combustion chamber 5 by way of injection holes.

Figure 1B:
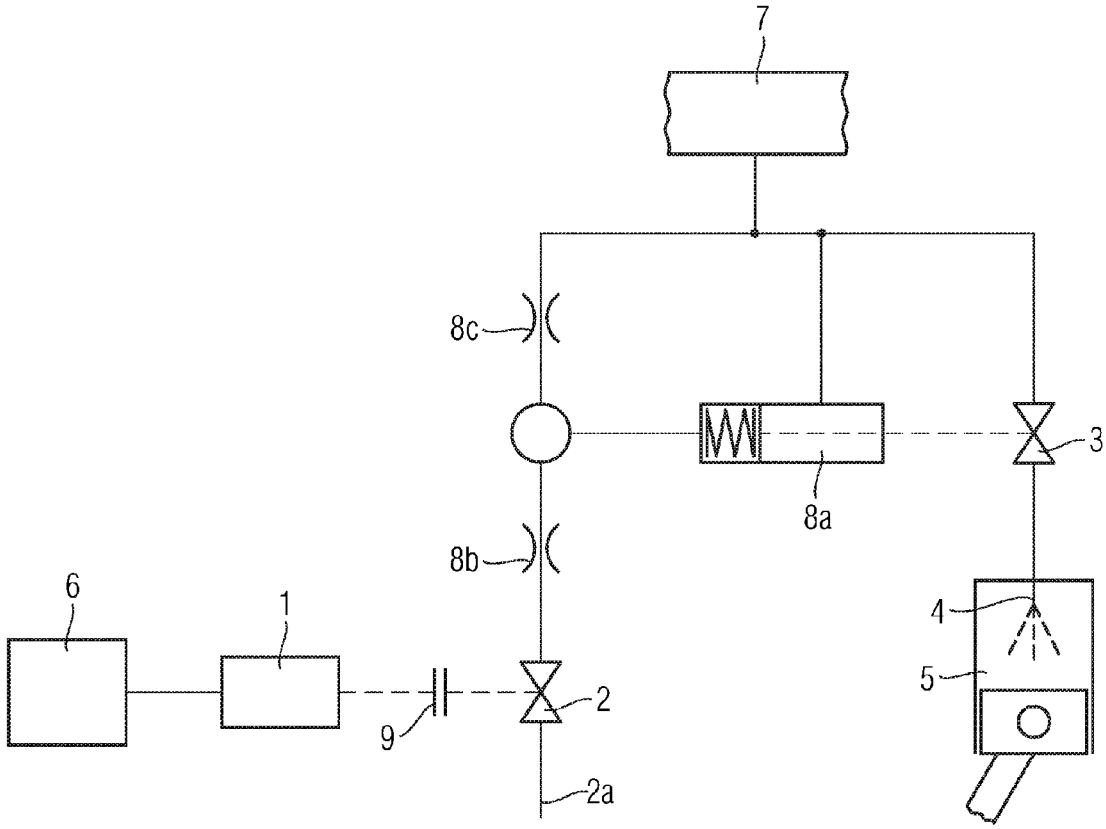
FIG. 1B shows a schematic view of individual elements of a structure for an indirect activation of an injection valve by way of a control valve in a fuel injector.

FIG. 1B shows a schematic representation of the structure by means of individual elements for an indirect activation of the injection valve by way of a control valve 2 in a fuel injector. The actuator (piezo or magnetic) 1, which is activated by means of the control device 6, now acts on the control valve 2, which has a return by way of a line 2*a*. Here the actuator 1 has to overcome an idle stroke before it comes into contact with the control valve 2.

The control valve 2 is connected to a hydraulic cylinder 8*a* with a recuperating spring, which is connected parallel to a throttle 8*c*, by way of a throttle 8*b*. The control valve 2 is connected to the rail 7 by way of the two elements 8*a*, 8*b*.

There is a further connection from there to the injection valve 3, which in turn injects fuel into the combustion chamber 5 by way of the injection nozzle 4.

Figure 2A:
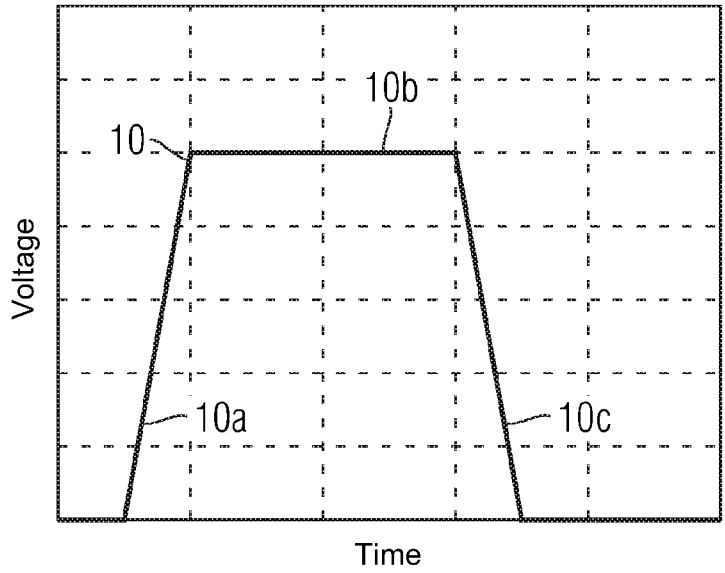
FIGS. 2A-D show voltage and flow-time diagrams of characteristic curves when a flow error and the correction thereof occur.

FIGS. 2A-E show a flow error by means of voltage-time diagrams and flow-time diagrams and the correction thereof. FIG. 2A shows the normally applied voltage according to the voltage characteristic curve 10 with the rising section or positive edge 10*a*, the highest value 10*b* and the falling section or negative edge 10*c*. The time difference between the voltage characteristic curve sections 10*a* and 10*c* is the time within which an injection takes place by way of the injection holes. This is referred to as the injection duration which, in this instance, is identical to the activation duration (TA), if the hydraulic pull (not shown here) equates to zero.

Figure 2B:
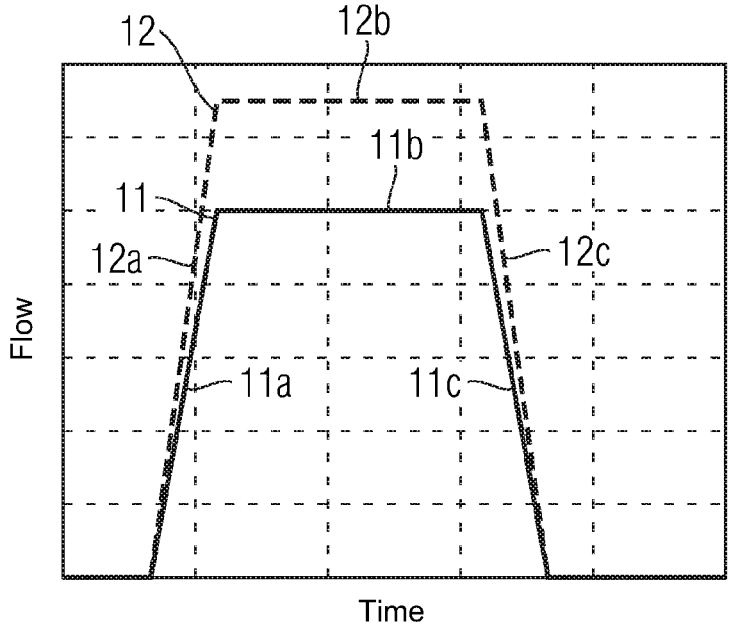

FIG. 2B shows the desired flow characteristic curve 11 according to a predetermined target characteristic curve and the measured actual flow characteristic curve 12 in a flow time-diagram. The target characteristic curve 11 again shows a rising characteristic curve section 11*a*, a characteristic curve section 11*b* with the maximum value and a falling characteristic curve section 11.

In the case of the measured flow characteristic curve, an increased maximum value 12*b*, which is not desirable, is present when there is a flow error. Rising and falling sections 12*a* and 12*c* are likewise present again.

Figure 2C:
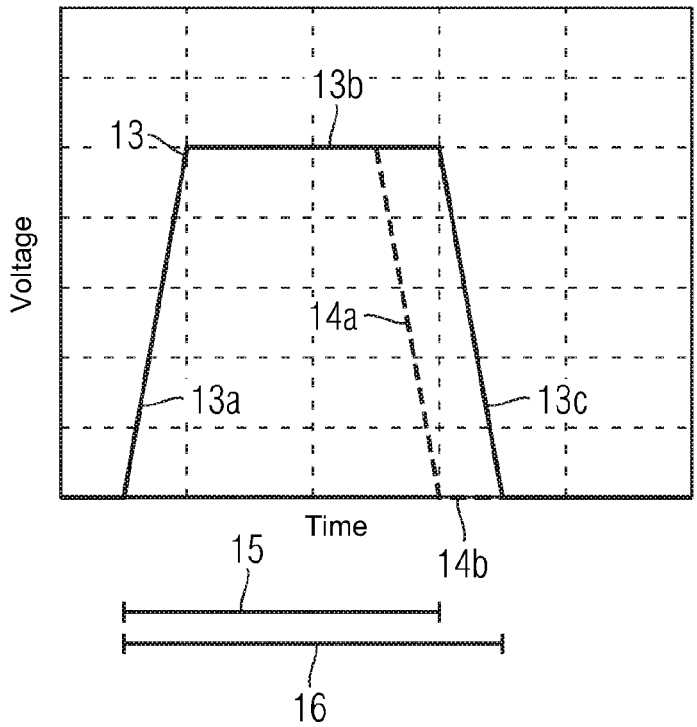
Figure 2D:
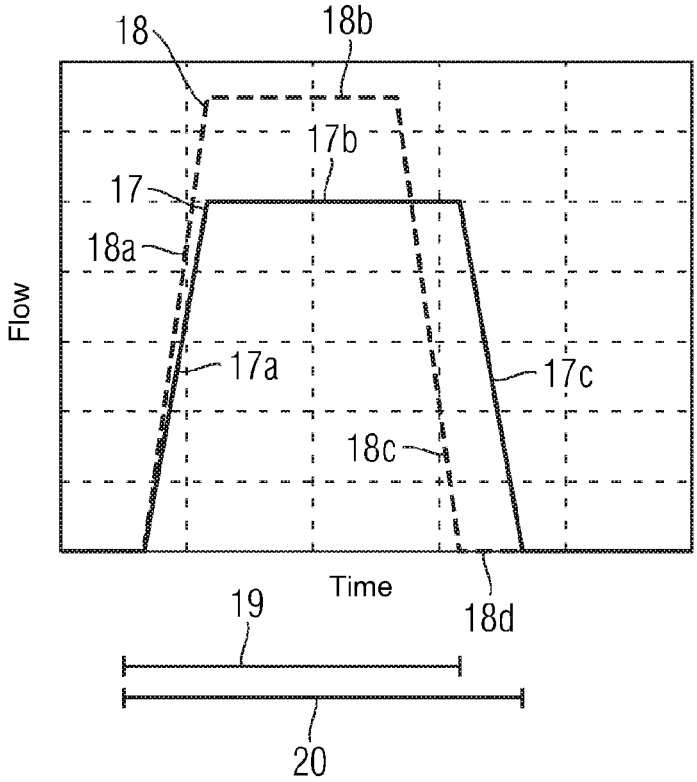

FIG. 2C likewise shows, as in FIG. 2D, a dashed characteristic curve which is used to achieve a corrected flow value. Relative to the target characteristic curve 13 with the sections 13*a*, 13*b* and 13*c*, a voltage characteristic curve 14*a* and 14*b* achieving compensation for the increased flow is embodied such that an early reduction in the voltage, shown in the sections 13*a* and 13*b*, takes place so that a shortened activation duration (TA) according to the reference character 15 is obtained compared with a previous injection duration 16. This results in the shortened flow duration and/or injection duration 19 shown in the flow-time diagram according to FIG. 2D, which is shortened compared with the previous flow duration and/or injection duration 20 according to the characteristic curve section 18*b*.

The flow characteristic curve 18 provided for compensation, which results from the modified voltage characteristic curve 14*a*, 14*b*, has the sections 18*a*, 18*b* and 18*c* as well as 18*d* relative to the target characteristic curve 17 with the sections 17*a*, 17*b* and 17*c*. Both characteristic curves 17 and 18 have the same flow integral.

The early reduction in the voltage characteristic curve according to section 14*a* and 14*b* thus advantageously achieves compensation for the flow error with too high a flow amount according to section 12*b*, by an early flow reduction taking place in the section 18*c*.

Figure 3A:
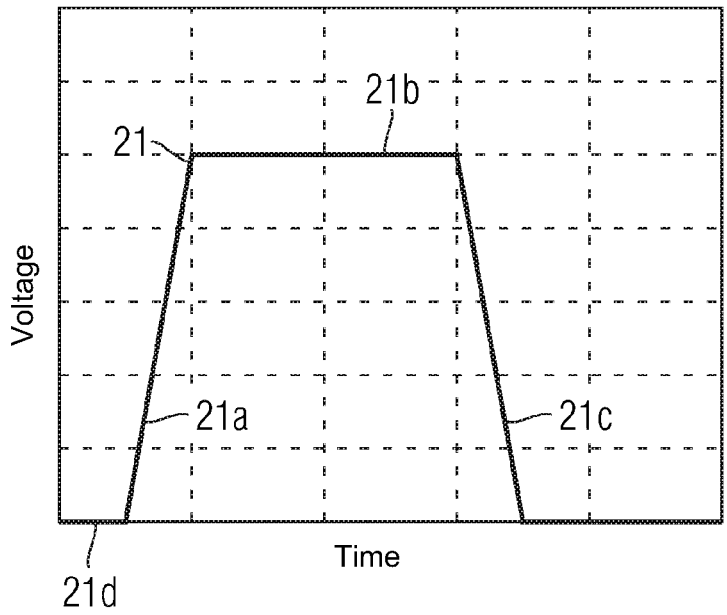
FIGS. 3A-D show voltage and flow-time diagrams of characteristic curves when a dead time error occurs.

FIGS. 3A-D show a dead time error and the correction thereof. In FIG. 3A, the voltage characteristic curve 21 has a rising section 21A, a maximum value 21*b* and a falling section 21C. Furthermore, the delayed start of the voltage increase according to section 21*a* is also shown in a section 21*d*.

Figure 3B:
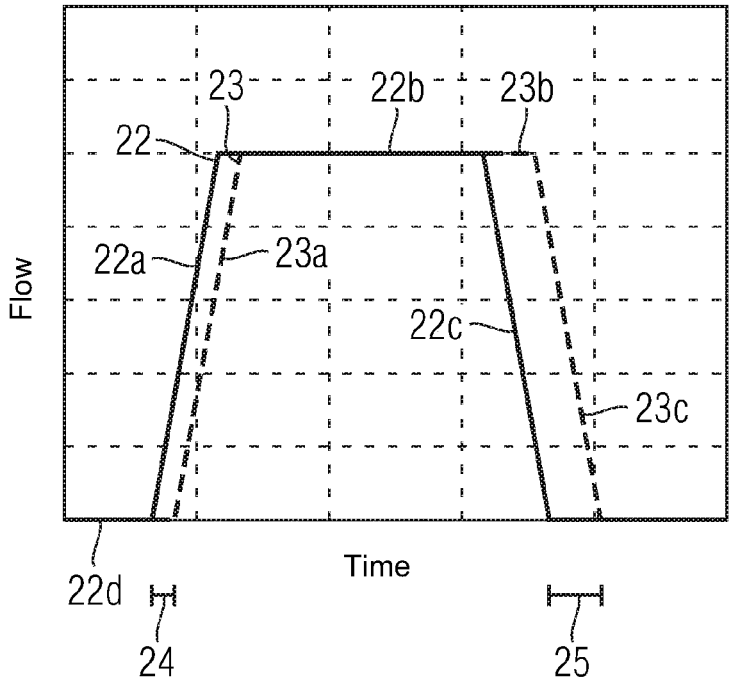

In FIG. 3B, the target characteristic curve 22 of the flow has the sections 22*a*, 22*b* and 22*c*, as well as the starting section 22*d*. When a dead time error occurs, a function-related temporal delay in the start of the flow takes place according to the dashed flow characteristic curve 23 with the rising sections 23*a*, the maximum value 23*b* and the falling section 23*c*. This is shown by the distance 24 on the x-axis in respect of the delayed increase and with the reference character 25 for the time interval of the delayed termination of the flow (shift to late).

Figure 3C:
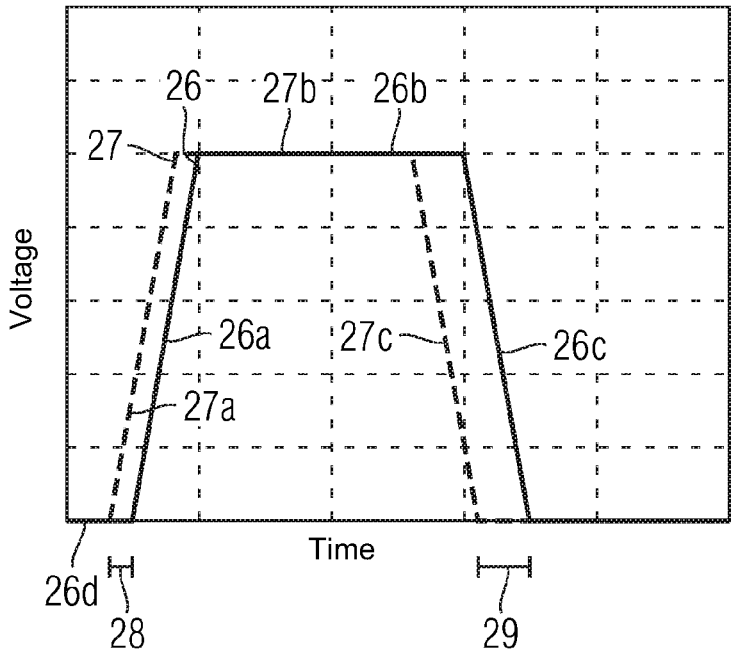

FIG. 3C shows the corrected voltage characteristic curve 27 relative to the target characteristic curve 26 to achieve compensation for the dead time error. The voltage characteristic curve 27 achieving the correction with the rising sections 27*a*, the maximum value 27*b* and the falling sections 27*c* has a temporal forward displacement relative to the target characteristic curve 26 with the sections 26*a*, 26*b*, 26*c* and 26*d*, this being shown by the reference characters 28 and 29 on the x-axis. The distances 28 and 29 correspond to the time intervals 24 and 25 apart from the fact that these are displaced temporally forward relative to the voltage target characteristic curve (shift to early).

Figure 3D:
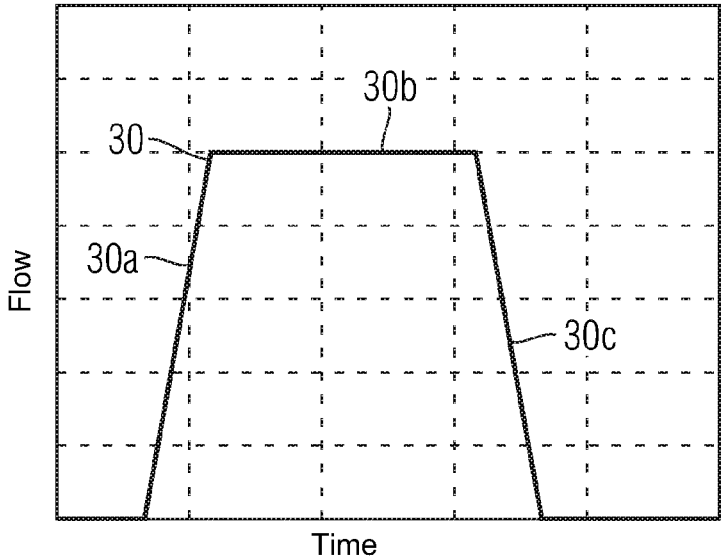

FIG. 3D shows the flow characteristic curve 30 obtained by the correction with the sections 30*a*, 30*b* and 30*c*, showing the corrected flow of a subsequently adjusted fuel injector taking the above dead time error into account.

Figure 4A:
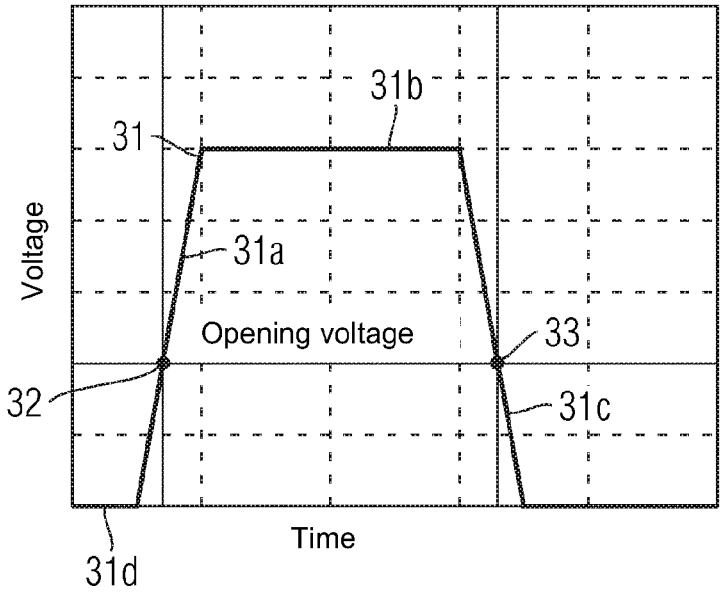
FIGS. 4A-D show voltage and flow-time diagrams of characteristic curves when an idle stroke error occurs.

FIGS. 4A-D show an idle stroke error in the form of the voltage and flow characteristic curves with an associated correction. A voltage characteristic curve 31, as shown in FIG. 4A, has the sections 31*a*, 31*b* and 31*c* with a predeterminable opening voltage at the voltage values 32 and 33. A delayed voltage increase occurs according to section 31*d*.

Figure 4B:
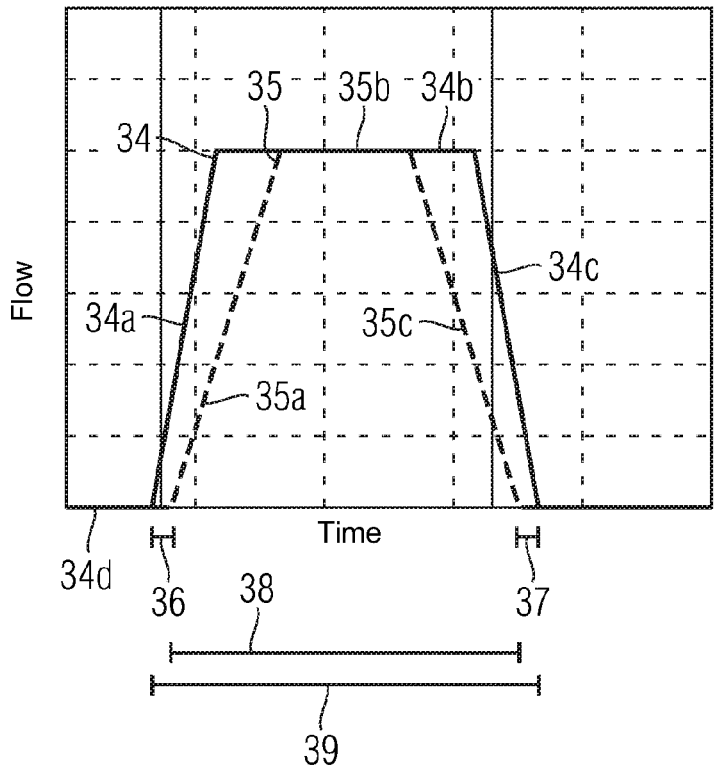

FIG. 4B shows the flow characteristic curve 34 underlying the voltage characteristic curve in FIG. 4A with an undesirable deviation characteristic curve 35. It is clearly apparent from this representation that the deviation flow characteristic curve 35 has a different drop according to the section 35*c* and a temporal shift in respect of the start and the end of the flow characteristic curve according to the reference characters 36, 37 relative to the target characteristic curve 34 with the sections 34*a-d* due to a slow rise according to section 35*a*. The maximum value 35*b* corresponds to the maximum value 34*b* according to the target characteristic curve. This produces a shortened activation duration (TA) 38 according to the previously applicable duration 39.

Figure 4C:
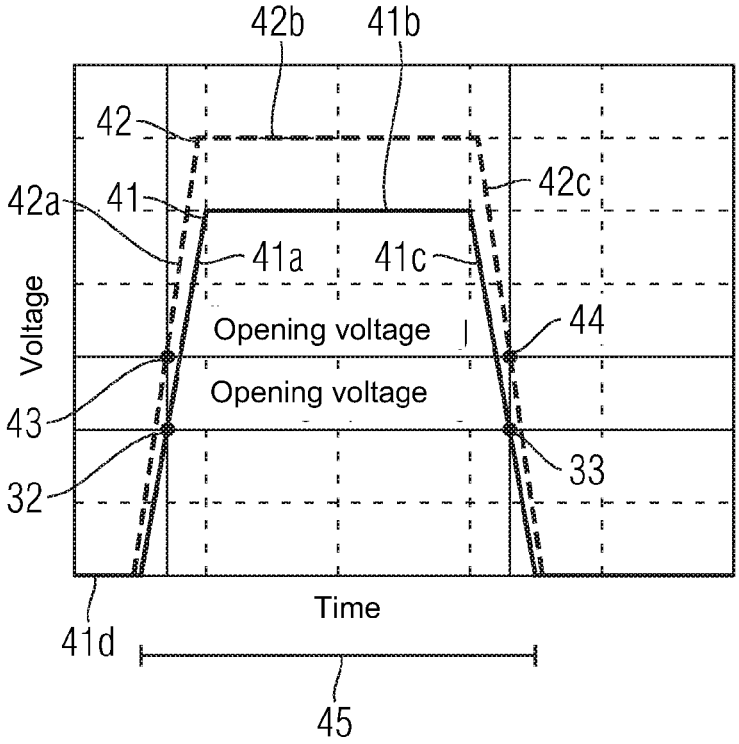

FIG. 4C shows the correspondingly corrected voltage characteristic curve for achieving a corrected flow. The voltage characteristic curve 42 has a steeper rise with a higher maximum value 42*b* and a steeper drop 42*c* relative to the target characteristic curve 41 with the sections 41*a*, 41*b* and 41*c* as well as 41*d*. The opening voltage values 32, 33 present in the target characteristic curve 41 are moved upward in the deviation characteristic curve 42 according to the voltage values 43, 44. The deviation characteristic curve 42 has an activation duration (TA) according to the reference character 45.

Figure 4D:
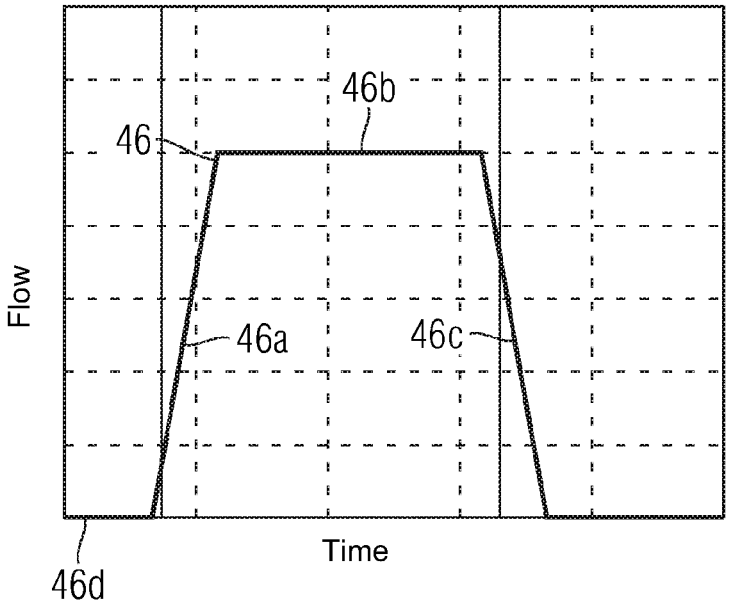

As a result of the corrected voltage signal according to FIG. 4*c*, a corrected flow characteristic curve 46 with sections 46*a*, 46*b*, 46*c* and 46*d* is obtained, according to FIG. 4D so that compensation for the undesirably deviating flow values from the characteristic curve 35 is achieved. The characteristic curve 46 is identical to the characteristic curve 34.

The method according to various embodiments is a method using injector variables in direct form, for which a so-called injector scatter, in other words deviations in the flow characteristic, can be compensated for between the different fuel injectors.

An adaptation of the method according to various embodiments is easily possible by linking it to other methods, for instance Minimum Fuel Mass Adaptation (MFMA) or Cylinder Balancing on the basis of the provision of injector variables in direct form. An almost complete correction of the fuel injector characteristics and parameters is possible.

What is claimed is:

1. A method for the calibration of fuel injectors for internal combustion engines with at least one actuator element corresponding to each fuel injector, the actuator elements opening at least one corresponding injection valve having an injection rate for the supply of fuel to a combustion chamber via injection holes, the method comprising:

applying an electric signal to an actuator element according to a stored characteristic voltage-time curve to actuate a particular fuel injector to cause a first injection;

directly measuring an actual flow of fuel into the combustion chamber using a test facility during the first injection to create a measured characteristic flow-time curve for the first injection;

comparing the measured characteristic flow-time curve for the first injection to a target characteristic flow-time curve; and in response to determining that the measured characteristic flow-time curve deviates from the target characteristic flow-time curve, modifying at least one of (a) a shape and (b) a start time of the stored characteristic voltage-time curve of the electric signal applied to the actuator element using a controller; and applying an electric signal to the actuator element according to the modified characteristic voltage-time curve to actuate the particular fuel injector to cause a second injection.

2. The method according to claim 1, wherein if a flow value which is too high or too low occurs, the at least partially simultaneously applied signal is reduced early or with a delay.

3. The method according to claim 1, wherein an early signal increase and an early signal drop are implemented if a delayed flow start and a delayed flow end occur.

4. The method according to claim 1, wherein an early signal increase and an increase in the maximum signal value are implemented if a delayed flow start and a reduced flow increase occur.

5. The method according to claim 4, wherein a delayed signal drop is implemented.

6. The method according to claim 4, wherein an opening signal value provided for the opening of the injection valve is increased.

7. The method according to claim 1, wherein the actuator element is embodied as a piezo element, which interacts with a control valve with a first stroke length, which controls the injection valve with a second stroke length, or directly interacts with the injection valve without the control valve.

8. The method according to claim 1, wherein the actuator element is embodied as a magnet element, which optionally interacts with the injection valve by way of a control valve.

9. The method according to claim 7, wherein the electric signal represents an applied electric voltage, the signal characteristic curve represents a voltage characteristic curve, the signal-time diagram represents a voltage-time diagram, the signal increase represents a voltage increase, the signal drop represents a voltage drop and the signal value represents a voltage value.

10. The method according to claim 1, wherein in order to determine the flow characteristic curve deviating from the target characteristic curve, the fuel quantity flowing through the injection holes is measured as a function of time in a test bench facility.

11. The method according to claim 1, wherein to determine the flow characteristic curve deviating from the target characteristic curve, measured time values in respect of the fuel quantity flowing through the injection holes are transformed in the frequency range and further processed there.

12. The method according to claim 1, wherein the modification values of the signal characteristic curve values produced are stored in or printed on a data carrier connected to the injector as correction values or assigned to different resistance values as correction values.

13. An apparatus for the calibration of fuel injectors for internal combustion engines having at least one actuator element corresponding to each fuel injector, the actuator elements opening the at least one corresponding injection valve with an injection rate for the supply of fuel to a combustion chamber via injection holes, the apparatus comprising:

a controller configured to apply an electric signal to an actuator element according to a stored characteristic voltage-time curve to actuate a particular fuel injector to cause a first injection;

a test facility configured to directly measure an actual flow of fuel into the combustion chamber during the first injection to create a measured characteristic flow-time curve for the first infection; and the controller further configured to:

compare the measured characteristic flow-time curve for the first injection to a target characteristic flow-time curve;

in response to determining that the measured characteristic flow-time curve deviates from the target characteristic flow-time curve, modify at least one of (a) a shape and (b) a start time of the stored characteristic voltage-time curve of the electric signal applied to the actuator element; and apply an electric signal to the actuator element according to the modified characteristic voltage-time curve to actuate the particular fuel injector to cause a second injection.

14. The apparatus according to claim 13, wherein the actuator element is embodied as a piezo element, which interacts with a control valve with a first stroke length, which controls the injection valve with a second stroke length, or directly interacts with the injection valve without the control valve.

15. The apparatus according to claim 13, wherein the actuator element is embodied as a magnet element, which optionally interacts with the injection valve by way of a control valve.

16. The apparatus according to claim 14, wherein the electric signal represents an applied electric voltage, the signal characteristic curve represents a voltage characteristic curve, the signal-time diagram represents a voltage-time diagram, the signal increase represents a voltage increase, the signal drop represents a voltage drop and the signal value represents a voltage value.

17. The apparatus according to claim 15, wherein the electric signal represents an applied electric voltage, the signal characteristic curve represents a voltage characteristic curve, the signal-time diagram represents a voltage-time diagram, the signal increase represents a voltage increase, the signal drop represents a voltage drop and the signal value represents a voltage value.

18. The apparatus according to claim 13, wherein in order to determine the flow characteristic curve deviating from the target characteristic curve, the fuel quantity flowing through the injection holes is measured as a function of time in a test bench facility.

19. The apparatus according to claim 13, wherein to determine the flow characteristic curve deviating from the target characteristic curve, measured time values in respect of the fuel quantity flowing through the injection holes are transformed in the frequency range and further processed there.

20. The apparatus according to claim 13, wherein the modification values of the signal characteristic curve values produced are stored as correction values in/on a data carrier connected to the injector or printed or assigned to different resistance values.

21. The method according to claim 8, wherein the electric signal represents an applied electric voltage, the signal characteristic curve represents a voltage characteristic curve, the signal-time diagram represents a voltage-time diagram, the signal increase represents a voltage increase, the signal drop represents a voltage drop and the signal value represents a voltage value.

* * * * *